US005176112A

United States Patent [19]

Sausner et al.

[11] Patent Number: 5,176,112

[45] Date of Patent: Jan. 5, 1993

[54] EVAPORATION-COOLED INTERNAL COMBUSTION ENGINE

[75] Inventors: Andreas Sausner, Frankfurt am Main; Klaus Mertens, Hemsbach, both of Fed. Rep. of Germany

[73] Assignee: Firma Carl Freudenberg, Weinheim an der Bergstrasse, Fed. Rep. of Germany

[21] Appl. No.: 788,701

[22] Filed: Nov. 6, 1991

[30] Foreign Application Priority Data

Jan. 31, 1991 [DE] Fed. Rep. of Germany ..... 4102853

[51] Int. Cl.[5] ..... F01P 9/02

[52] U.S. Cl. ..... 123/41.21; 123/41.5

[58] Field of Search ..... 123/41.2, 41.21, 41.27, 123/41.5, 41.51

[56] References Cited

U.S. PATENT DOCUMENTS

| | | | |
|---|---|---|---|
| 1,643,510 | 9/1927 | Muir | 123/41.21 |
| 3,162,183 | 12/1964 | Gratzmuller | 123/41.21 |
| 4,473,037 | 9/1984 | Michassouridis et al. | 123/41.27 |

FOREIGN PATENT DOCUMENTS

| | | | |
|---|---|---|---|
| 1252221 | 12/1959 | France | 123/41.15 |

*Primary Examiner*—Noah P. Kamen

*Attorney, Agent, or Firm*—Sprung, Horn, Kramer & Woods

[57] ABSTRACT

An evaporation-cooled internal combustion engine having a cooling system that can be pressurized and that includes a surge tank and a radiator. The surge tank (1) communicates through a line (2) with a section of the cooling system (3) that is constantly full of liquid coolant while the engine is in operation. The engine operation is thereby unaffected by low ambient temperatures.

15 Claims, 6 Drawing Sheets

EVAPORATION-COOLED INTERNAL COMBUSTION ENGINE

BACKGROUND OF THE INVENTION

The invention concerns an evaporation-cooled internal combustion engine wherein a liquid coolant can flow through a pressurizable cooling system that includes a surge tank and a radiator.

Such an internal combustion engine is known from the U.S. Pat. No. 4 648 356. The cooling system essentially comprises a water jacket on the internal combustion engine, a radiator in the form of a condensation radiator, a condensate tank, and a tank divided into two compartments by a partition. The compartment facing away from the cooling system is open to the atmosphere. The objective is to temporarily extract the air from the hermetically sealed system and keep it away from the condenser in order to improve the system's function. Air, which is detrimental to the system, is stored in the partitioned tank while the engine is operating and warm, and is returned to the system as the engine cools in order to prevent the occurrence of a vacuum.

It must be taken into consideration that much of the cooling system becomes wet when the engine cools. When the ambient temperature is low, the moisture can freeze inside the system and lead to malfunction or destruction of the cooling system. The design also requires delicate sensors to detect the level of the liquid. It is difficult to control the cooling action precisely. The volume of condensate cannot be regulated in relation to its temperature, a situation that can occasion stress cracks in the engine parts when the temperature of the condensate differs extensively from that of the components. It is also comparatively complicated to replenish the system with coolant, which must be precisely measured.

SUMMARY OF THE INVENTION

The principal object of the present invention is to provide an improved evaporation-cooled internal combustion engine of the aforesaid type that will operate unaffected by low ambient temperatures and that will have a considerably more efficient, reliable, and easier to operate cooling system.

This object, as well as other objects which will become apparent in the discussion that follows, are achieved in an internal combustion engine of the aforesaid type by providing a surge tank which communicates through a line with a section of the cooling system that is constantly full of liquid coolant while the engine is in operation. At least one relatively movable, fluid-tight partition is associated with the surge tank. The partition divides the tank into a liquid-coolant compartment and a spring compartment. The liquid stored in the tank has two functions. It equalizes the pressure and provides supplementary water when needed. Even in hazardous driving conditions, when a curve is being taken at high speed for example, and when there is a lot of vapor in the condenser, it will be impossible for the coolant pump to draw vapor instead of liquid coolant. This feature makes for an extremely reliable cooling system.

The boiling point of the coolant employed in evaporation cooling depends on the pressure in the cooling system. The shape of the system-pressure curve is dictated by the relatively movable, fluid-tight partition in the surge tank. The spring compartment in the surge tank can be hermetically sealed. The relatively movable partition can rest against the cushion constituted by the imprisoned air. It can alternatively rest against a spring in the spring compartment if the latter is open to the atmosphere. The pressure on the spring increases with the pressure in the cooling system and with the volume of coolant in the coolant compartment.

The cooling system can contain at least one condensation radiator. Such a radiator is especially inexpensive and works well. It is particularly appropriate for industrial-scale manufacture.

A convection radiator parallels the condensation radiator in one advantageous embodiment of the invention. The advantage is that the temperature of the coolant in the vicinity of the coolant pump will equal the temperature of the condensate combined with that of the convection-cooled coolant. Since this temperature will always be below the boiling point of the coolant, no cavitation will occur, even from the suction generated by the coolant pump. The pump will last longer because it pumps without vapor. Another advantage is that the temperature of the liquid coolant entering the internal combustion engine is extensively constant.

The condensation radiator can have coolant-distribution lines. This approach increases the efficiency of the condenser by ensuring that any condensate that occurs will leave the coolant-distribution lines for the coolant-outlet line particularly rapidly. Another advantage is that coolant will enter the coolant-distribution lines above the surface of the liquid coolant in an engine that is in operation and warm. This embodiment ensures that only evaporated and gaseous coolant will travel through the coolant-distribution lines unaccompanied by any liquid, further increasing the cooling system's efficiency.

To ensure that only evaporated coolant travels through the condenser coolant-distribution lines while the engine is operating and warm, a condensate-recirculation line can be associated with the condensation radiator. The condensate-recirculation line will forward any condensate that occurs in the vicinity of the entrance into the coolant-distribution lines toward the coolant pump without allowing it to travel through the condensation radiator. The condensate-recirculation line also contributes to the cooling system's high efficiency.

The cooling system can have a coolant-intake line and a coolant-outlet line and can to advantage be completely full of liquid coolant during vapor-free operation. This cooling system is outstanding on account of its satisfactory operating properties, replenishment facility, and high reliability. Since the cooling system can be filled to the brim through its neck when the engine is cool, precise measurement of the liquid coolant is unnecessary. Both the cooling system and the internal combustion engine have air-removal lines that terminate in the cap on the neck. The same cap includes a safety valve that opens to the atmosphere when the pressure in the system increases to a critical level, allowing vapor to escape. Since the radiator is completely full of coolant during vapor-free operation, the radiator cannot be frost-damaged even at low winter temperatures. The coolant, which usually consists of water and antifreeze, occupies the entire cooling system and, in contrast to the state of the art, has no regions unprotected from freezing. It is also possible for any vapor that enters the condenser to entrain some liquid, which will be intercepted in the vicinity of the condenser coolant-distribution lines and forwarded to the coolant pump along with its percentage of antifreeze through the condensate-recirculation line.

One especially simple and inexpensive-to-manufacture embodiment has a check valve between the coolant-intake line and the coolant-outlet line that permits flow only toward the coolant-outlet line. The purpose of this valve is to open a direct access between the coolant-intake line and the coolant-outlet line when there is no vapor in the internal combustion engine, while it is being started up and immediately thereafter, that is, to allow the circulating coolant to heat up rapidly without being cooled. Rapid heating during the warm-running phase minimizes wear on the adjacent internal combustion engine and decreases pollution.

Another advantageous embodiment has a thermostatic valve upstream of the coolant-outlet line. The thermostatic valve can be associated with the convection radiator and with a bypass adjacent thereto, controlling the flow of coolant from the convection radiator and bypass to the coolant-outlet line. An externally controlled valve can be employed instead of a thermostatic valve. A thermostatic valve, however, is of particular advantage for controlling the temperatures of the various components of the internal combustion engine. When the engine is cold, the thermostatic valve will close the convection radiator off to the coolant and will open up the bypass. The coolant will travel a relatively direct route from the coolant-intake line to the coolant-outlet line by way of the bypass without flowing through the radiator. The engine's warm-operation phase will be abbreviated and both wear and pollution reduced. As the temperature of the coolant increases, the thermostatic valve will gradually close off the route through the bypass and open the channel through the radiator. The cooled coolant will now be returned to the internal combustion engine to cool it. One advantage is that the cooling system will operate consistently. Interference from turning the passenger-compartment heating system on and off or from the oil cooler for example will be reduced. Another advantage is that the increased flow of coolant through these components will result in more heating and cooling power.

A coolant pump can be accommodated in the radiator's coolant-outlet line and have associated with it another check valve that permits flow only toward the internal combustion engine. One advantage is that the engine can be located at any level in relation to the radiator without the coolant being able to flow back into the radiator from the engine. This feature ensures that there will always be enough coolant in the internal combustion engine. Once the internal combustion engine has been turned off and the condensation radiator is almost completely occupied by vapor, it will be impossible for any coolant in the engine to flow back into the radiator when the coolant pump is off and lead to overheating and irreparable damage to the engine.

A valve can be positioned upstream of the coolant pump. It will be practical for the valve to be between the condensate-recirculation line from the radiator and the line to the adjacent coolant pump. The valve in one advantageous embodiment can be a float that closes off the line to the coolant pump when necessary without blocking the line between the surge tank and the coolant pump. If for example a curve is being taken at high speed and there is no more liquid coolant within the suction range of the coolant pump, the valve will close off the route from the radiator to the pump. The pump will then temporarily suction liquid coolant from the reservoir constituted by the surge tank and forward it to the internal combustion engine. Once the level of liquid coolant in the radiator rises again, the valve will open, allowing the coolant pump to draw liquid coolant out of the radiators.

Another valve can be positioned upstream of the condensation radiator. If there is a convection radiator paralleling the condensation radiator, the second valve will be positioned upstream of it as well. The second valve can also be a float. The second valve is intended to not open a channel through the radiator until the coolant has heated up and has already evaporated to some extent. As the evaporation commences, the pressure rises, and the level of coolant accordingly drops, the second valve will open up an access to the adjacent radiators, cooling the internal combustion engine and preventing it from overheating.

The partition in the surge tank can be part of a piston. A piston separating a surge tank into a liquid-coolant compartment and a spring compartment is a component that is particularly easy and economical to manufacture. The partition can, however, alternatively be a roller diaphragm.

The partition can rest against a compression spring accommodated in the spring compartment. One advantage is that the spring will be separated from any coolant, so that not only helical and cup springs but also resilient foam and elastomers can be employed, with operating properties unaffected by immersion in coolant.

The spring compartment can communicate with the internal combustion engine's intake system through a vacuum line that can be closed off by at least one shut-off valve. This feature assumes of course the presence of a vacuum system and of one that can generate enough suction to unexceptionably activate the partition. If the internal combustion engine is a Diesel engine, the vacuum line can advantageously communicate with the brake system vacuum pump.

The boiling point of the coolant employed in evaporation cooling is dictated by the pressure in the cooling system. The temperature of the internal combustion engine can be optimally adjusted to the particular load in accordance with the level of the system pressures in the cooling system and with the related differences in the boiling point of the coolant. The relatively movable, gas-tight partition can be subjected to vacuum to regulate the system pressure. The vacuum can be generated by the internal combustion engine's intake system or by a special vacuum pump. Displacing the partition in the surge tank will regulate the total capacity of the cooling system and hence the system pressure in accordance with the operating point of the internal combustion engine. The desired system pressure can be calculated for example from the coolant temperature, the component temperature, the level of vacuum in the intake pipe, the state of the throttle valve, the revolutions per minute, how much fuel is injected, the ambient temperature, and the speed of the vehicle. Since many of these parameters are already accessible in an electronically controlled internal combustion engine, no additional sensors are necessary.

A vacuum reservoir can be associated with the vacuum line. This makes particular sense if the internal combustion engine's intake system does not have enough vacuum available subject to every load to adjust the system pressure in the cooling system to any load. When the engine is idling and a comparatively high system pressure is necessary, dictating in turn a high boiling point and hence rapid engine warming, the intake system will make a strong vacuum available in the absence of a vacuum reservoir, whereas at full load, when a lower system pressure and coolant-boiling point are necessary to prevent the engine from overheating, the intake system will generate only a weak vacuum and often not enough to further decrease the system pressure in the cooling system. To eliminate these drawbacks accordingly, the vacuum line accommodates a vacuum reservoir to ensure presence of enough vacuum to supply the equilibrating space in the surge tank.

The preferred embodiments of the evaporation-cooled internal combustion engine in accordance with the invention will now be described with reference to the accompanying drawings.

DESCRIPTION OF THE PREFERRED EMBODIMENTS

Figure 1:
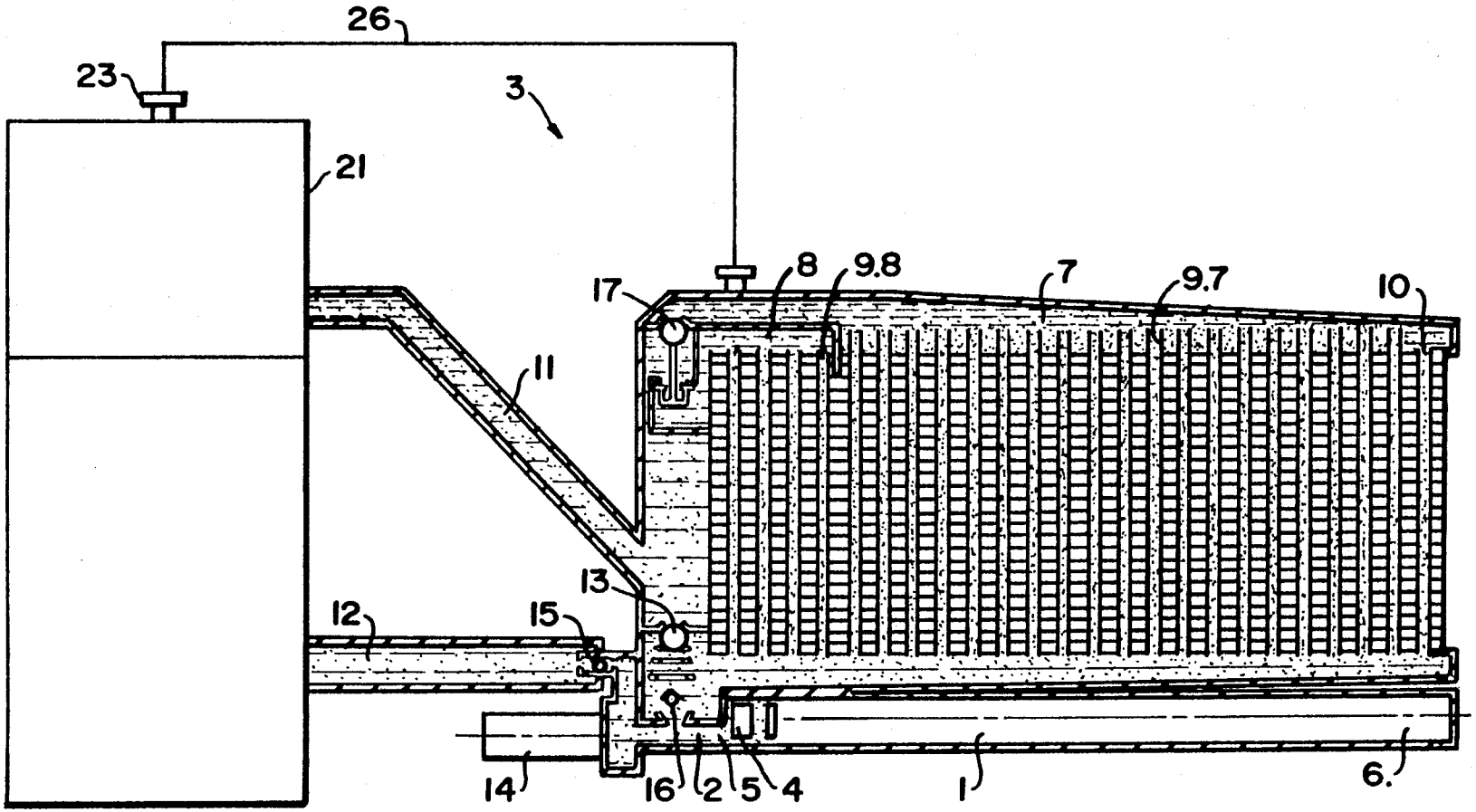
FIG. 1 is a schematic diagram of an evaporation cooled internal combustion engine according to a first preferred embodiment of the present invention.

FIGS. 1-6 schematically illustrate an evaporation-cooled internal combustion engine 21 having a pressurizable cooling system 3 which includes a surge tank 1 and a radiator. The radiator in these embodiments comprises a condensation radiator 7 and a parallel convection radiator 8. Associated with surge tank 1 is a relatively movable, fluid-tight partition 4 in the form of a piston. The partition divides surge tank 1 into a liquid-coolant compartment 5 and a spring compartment 6. At least condensation radiator 7 accommodates upright coolant-distribution lines 9.7, which are particularly evident from FIGS. 1 through 3. The condensation radiators 7 illustrated in FIGS. 4 through 6 also have upright coolant-distribution lines extending through them, although they have been omitted from the drawing for simplicity's sake. In addition to the upright lines, all the figures illustrate a condensate-recirculation line 10 accommodated in condensation radiator 7. The upright lines and the condensate-recirculation line improve the efficiency of cooling system 3.

The surge tank illustrated in FIG. 1 is sealed off from the environment. When the pressure in cooling system 3 rises and partition 4 is displaced toward spring compartment 6, the gas confined therein acts like an air cushion. The partition 4 illustrated in FIG. 2 rests against a compression spring 18 accommodated in spring compartment 6, which communicates with a suction system 22 by way of a vacuum line 19. Vacuum line 19 accommodates a shut-off valve 20 that can be closed as needed.

Figure 2:
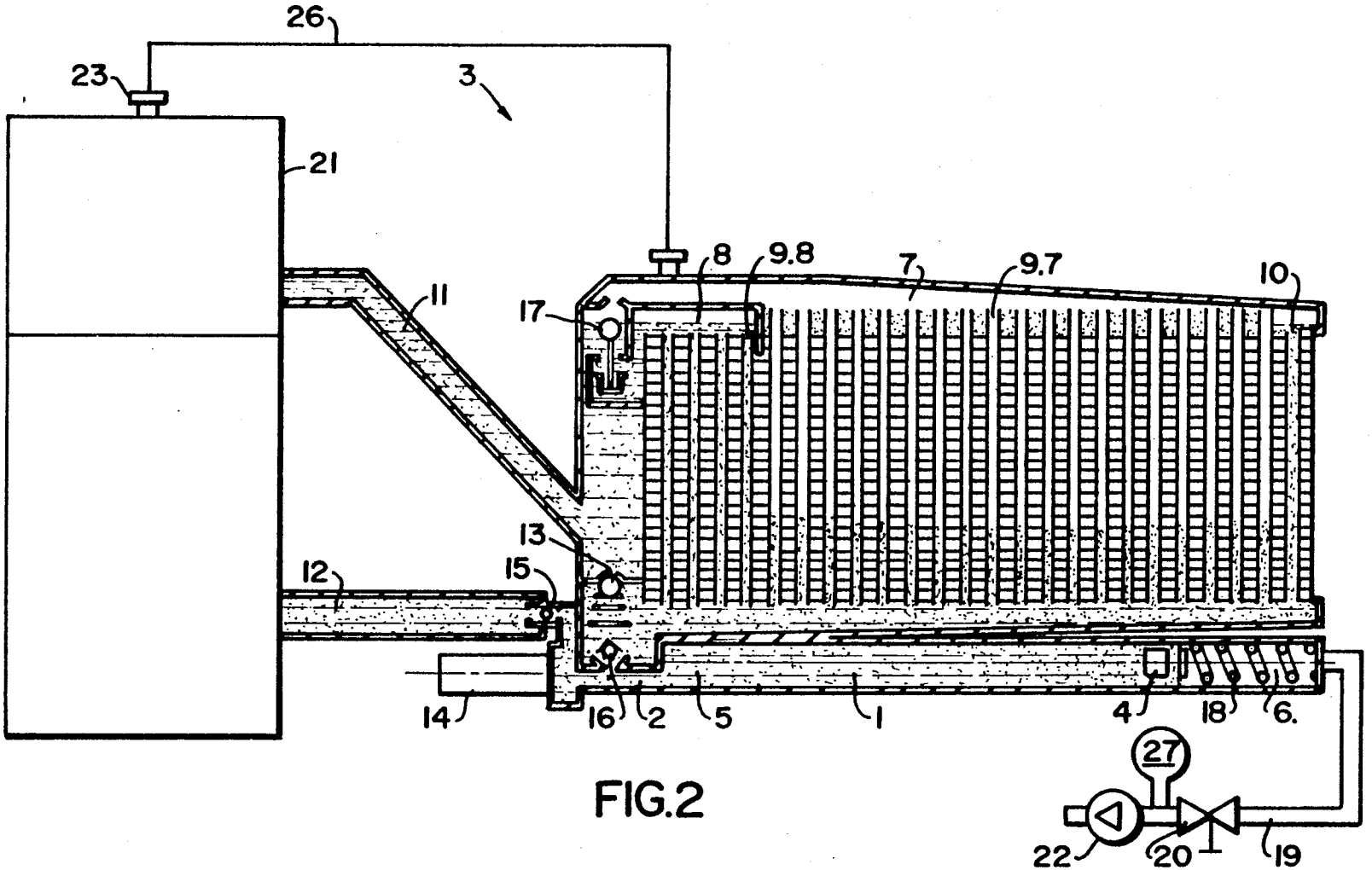
FIG. 2 is a schematic diagram of an internal combustion engine according to a second preferred embodiment of the present invention.
Figure 3:
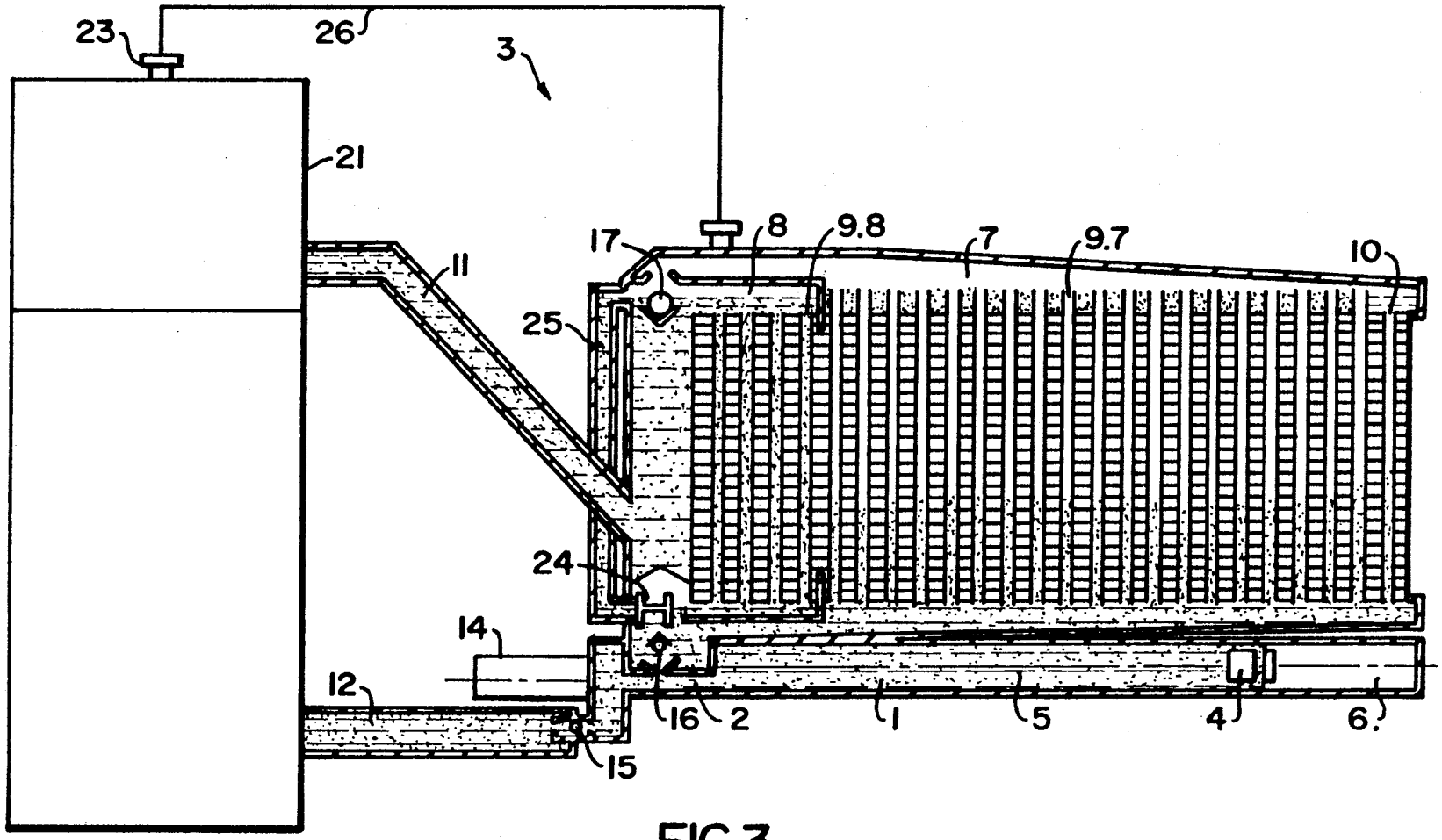
FIG. 3 is an evaporation cooled internal combustion engine according to a third preferred embodiment of the present invention.

The first check valve 13 illustrated in FIGS. 1 and 2 is replaced in FIG. 3 by a thermostatic valve 24 that regulates the flow of coolant from convection radiator 8 and bypass 25 toward coolant-outlet line 12 in accordance with the temperature of the coolant. The temperature of the coolant arriving at coolant pump 14 is composed of no more than three component temperatures. It is derived from the temperature of the uncooled coolant from bypass 25, that of the coolant flowing through convection radiator 8, and that of the condensate emerging from condensation radiator 7. Using thermostatic valves with expansion elements having various coefficients of expansion will make it possible to operate, in principle, the same type of cooling system in various combustion engines that must be cooled by different amounts.

Figure 4:
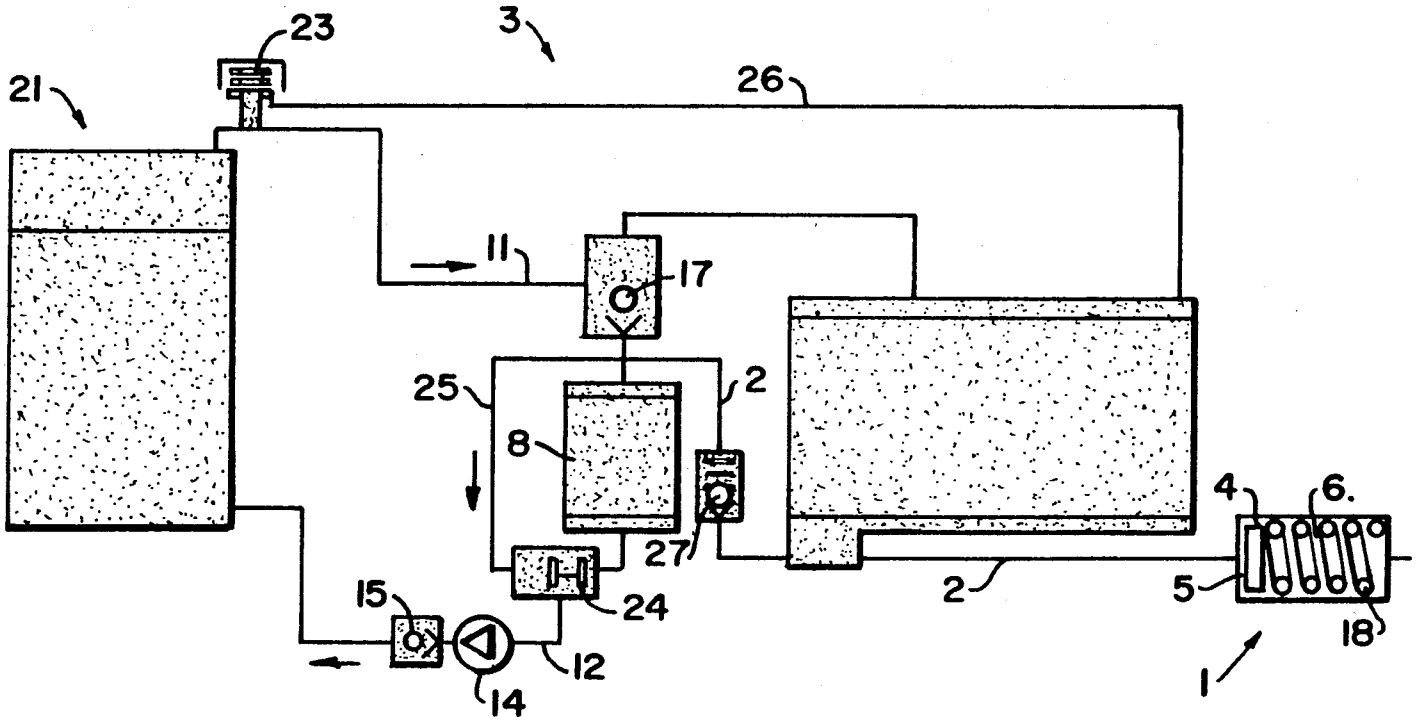
FIG. 4 is a block diagram of a cold evaporation cooled internal combustion engine in accordance with the invention before or just after being started.
Figure 5:
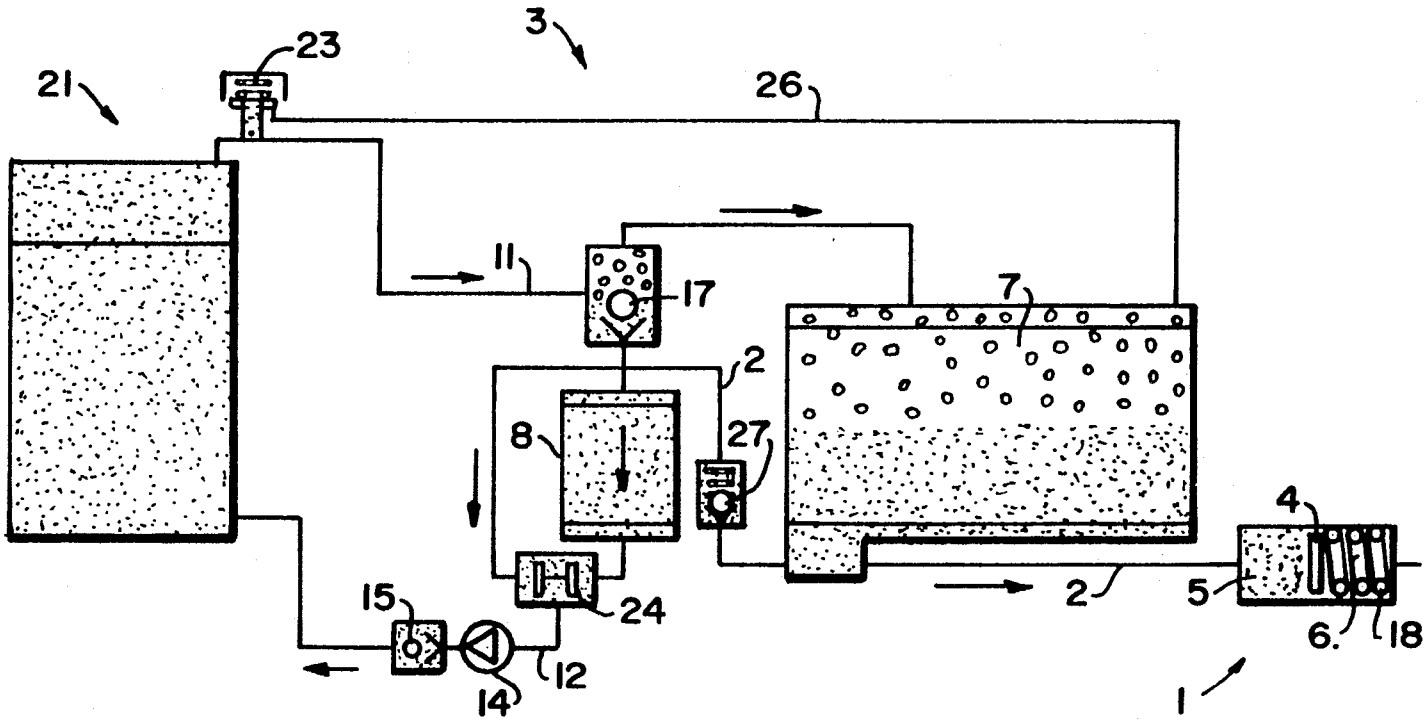
FIG. 5 is a block diagram of the internal combustion engine of FIG. 4 with less heat being supplied than is extracted from the system.
Figure 6:
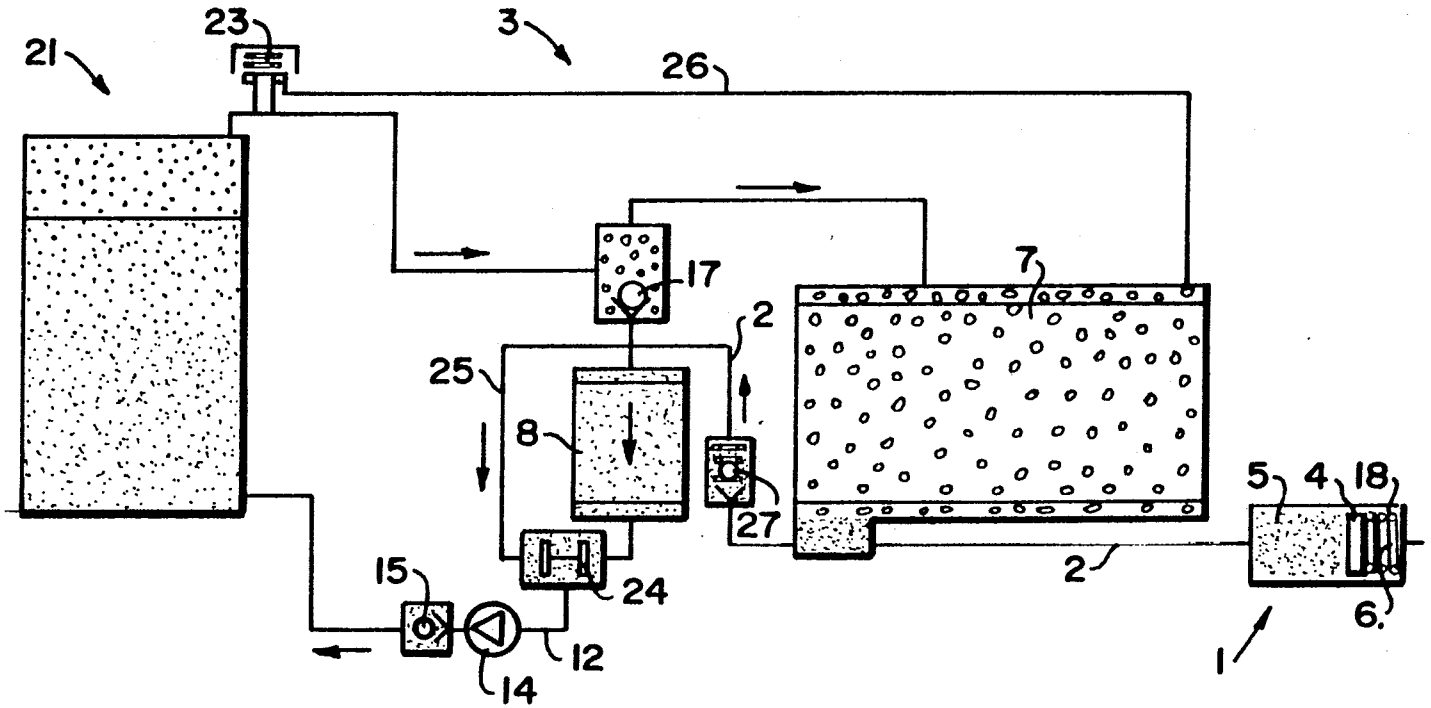
FIG. 6 is a block diagram of the internal combustion engine of FIG. 4 with as much heat being supplied as is extracted.

The evaporation-cooled internal combustion engines illustrated in FIGS. 1 through 3 are distinguished by their compactness, simplicity, and manufacturing economy. FIGS. 4 through 6 represent an evaporation-cooled internal combustion engine in the form of a block diagram for simplicity's sake. It would of course also be possible to accommodate the components in a housing as illustrated in FIGS. 1 through 3. The details of condensation radiator 7 and convection radiator 8 will be evident from FIGS. 1 through 3.

FIG. 4 illustrates a cold evaporation-cooled internal combustion engine in accordance with the invention before or just after being started. The cooling system is completely full of coolant and free of vapor. The liquid-coolant compartment 5 in surge tank 1 is at its lowest capacity.

FIG. 5 illustrates the internal combustion engine illustrated in FIG. 4 with less heat being supplied than extracted.

FIG. 6 illustrates the extreme case the cooling system is designed to deal with. As much heat is being supplied as extracted. This situation can occur, for example, when a vehicle is driven for long periods over mountains at full load at slow speeds.

FIGS. 4 through 6 differ mainly from FIGS. 1 through 3 in that the direct communication between surge tank 1 and condensation radiator 7 and coolant-outlet line 12 is closed and communicating line 2, which accommodates a check valve, opens into bypass 25. The major advantage cf the embodiment illustrated in FIGS. 4 through 6 is that the condensate is not supplied directly to the internal combustion engine. This prevents the comparatively cold condensate from being forwarded directly to a very hot internal combustion engine (under full load), where it could occasion heat stress and eventually even cracks.

The thermostatic valve, which is represented herein by way of example as positioned where the coolant leaves the convection radiator and bypass, could also be positioned where it enters. It has the same function as the thermostatic valve illustrated in FIG. 3.

The system operation will now be described.

FIG. 1 illustrates the evaporation-cooled internal combustion engine 21 with a vapor-free cooling system 3 just after being started and before it has attained optimal operating temperature. Both convection radiator 8 and condensation radiator 7 are completely full of a liquid coolant consisting of water with antifreeze added to it. Thus, the radiator cannot be damaged by freezing, even when the ambient temperature is very low. Cooling system 3 is also very easy to replenish with coolant. The cap on neck 23 is removed and coolant is poured in until it reaches the level of the neck.

Another valve 17, which is in the form of a float completely surrounded by coolant, rests against an upper seat toward condensation radiator 7. Second valve 17 also seals off the access to convection radiator 8. With second valve 17 closed, the suction generated by coolant pump 14 will open first check valve 13 and first valve 16, which is, like second valve 17, a float. The coolant will now be pumped over a short loop through internal combustion engine 21. The coolant from coolant-intake line 11 will travel through first check valve 13 and first valve 16 to coolant pump 14 and will return thence through second check valve 15 to internal combustion engine 21. First check valve 13 will remain open only while second valve 17 is closed. The capacity of surge tank 1 will be smallest in the vicinity of liquid-coolant compartment 5. The capacity of spring compartment 6 will be at its maximum.

FIG. 2 represents the internal combustion engine 21 illustrated in FIG. 1 at operating temperature. Some of the liquid coolant has already evaporated, and most of that is in condensation radiator 7. The elevated pressure in cooling system 3 has displaced the partition 4 in surge tank 1 toward spring compartment 6 to make room for the vapor. The evaporated portions of the coolant have lowered the level of the liquid coolant in convection radiator 8 and condensation radiator 7, whereupon second valve 17 has opened up a channel toward condensation radiator 7. The channel to convection radiator 8 has simultaneously been opened up and liquid coolant is flowing through it. The entrance into the coolant-distribution lines 9.7 in condensation radiator 7 is on approximately the same level as the seat of second valve 17 and, once evaporation commences, will rapidly be surrounded only by vaporous coolant. This feature ensures that only vapor will flow through the coolant-distribution lines 9.7 in condensation radiator 7, which extraordinarily increases efficiency. The liquid coolant in the vicinity of the entrance into coolant-distribution lines 9.7 is extracted by way of condensate-recirculation line 10. The advantage of upright coolant-distribution lines 9.7 and 9.8 is that they contribute to the cooling system's efficiency. First check valve 13 will keep the direct route to coolant pump 14 closed as long as second valve 17 remains open, and the coolant must travel through the radiators. This feature eliminates the hazard of internal combustion engine 21 overheating. First valve 16 will remain open and will keep the route to coolant pump 14 open as long as it has liquid coolant flowing around it. The essential purpose of the first valve is to ensure that coolant pump 14 will suction in only liquid coolant. The liquid coolant in the condenser can, for example, drop during a long trip at full load to a level at which first valve 16 will remain just slightly open, and in extreme situations, when the vehicle is driven around a curve at high speed for example, the residual coolant can be forced out of the suction range of coolant pump 14 by centrifugal force. In this event first valve 16 will close off the channel from the radiators to the coolant pump, and coolant pump 14 will no longer draw up any vaporous coolant, which can occasion cavitation in, and destruction of the pump. Coolant pump 14 will, however, temporarily draw liquid coolant from surge tank 1 instead and forward it to internal combustion engine 21 to cool it. Once there is enough liquid coolant in the radiators again, first valve 16 will open and open up the channel from the radiators to coolant pump 14 again. The purpose of second check valve 15 is to prevent the coolant in coolant outlet line 12 from flowing back to the radiator. This feature ensures that there will always be enough liquid coolant in internal combustion engine 21.

The partition 4 illustrated in FIG. 2, unlike the one illustrated in FIG. 1, rests against a compression spring 18, and spring compartment 6 communicates with a vacuum pump 22 by way of a vacuum line 19 that accommodates a shut-off valve 20. It is, however, also possible for vacuum line 19 to communicate with the intake system in internal combustion engine 21. Advantageously, a vacuum reservoir 27 may be provided to maintain a steady source of vacuum.

Alternatively, if the engine is a Diesel, the vacuum line may be connected with the braking system's source of vacuum. The system of components illustrated herein makes it possible to regulate the system pressure in cooling system 3, adjusting the cooling curve to represent operating conditions of internal combustion engine 21. The system pressure in cooling system 3 can in particular be lowered when the vehicle is operated at full load in order to decrease the coolant's boiling point. Evaporation commences earlier and increases the cooling, providing more protection against overheating on the part of internal combustion engine 21.

FIG. 3 illustrates an internal combustion engine 21 with a cooling system 3 essentially similar to that illustrated in FIG. 2. It differs from the latter only in that the cooling system accommodates a bypass 25 and a thermostatic valve 24. Internal combustion engine 21 is at its optimal operating temperature, and thermostatic valve 24 has closed off bypass 25 and simultaneously opened up an exit for coolant from convection radiator 8. The liquid coolant is being conveyed through convection radiator 8 and the gaseous coolant through condensation radiator 7 and cooled. The cool coolant is then returned to internal combustion engine 21 by way of coolant-outlet line 12. This system makes it possible to advantageously adapt the temperature of the coolant removed by way of coolant-outlet line 12 to specific operating points of internal combustion engine 21. Adaptation to components accommodated in coolant-outlet line 12 and with coolant flowing through them is also more effective. Components that have coolant flowing through them and that ar accommodated in coolant-outlet line 12 can, for example, comprise the passenger-compartment heating system and/or an oil radiator, neither of which is illustrated. Another advantage of the particular system in question is that cooling system 3 has constant operating properties and that interference is minimized, especially in comparison with components that are installed paralleling the radiator. The passenger compartment heating system, for example, will also be more effective due to the greater volume of coolant flowing through it.

FIG. 4 illustrates an evaporation-cooled internal combustion engine 21 with a cooling system 3 that has a thermostatic valve 24 similar to that in the system illustrated in FIG. 3. The cooling system illustrated in this figure is cold and without vapor. In this state the system can easily be replenished through neck 23. Air removal line 26 will be open as long as neck 23 is open. The passenger compartment heating system can also be attached to this line. Second valve 17 is a float and remains open as long as a third check valve 27 downstream of condensation radiator 7 is closed. The liquid coolant is thermostatically forwarded to internal combustion engine 21, Coolant pump 14 can be disconnected during the warm-running phase to heat more rapidly the internal combustion engine. It is also possible to keep coolant pump 14 running once the engine has been turned off to eliminate the temperature coasting that occurs in a suddenly turned-off internal combustion engine 21, for example, subsequent to long trips at full load. Thermostatic valve 24 will close off the channel through convection radiator 8, and the liquid coolant will travel in a small loop through the bypass toward coolant-outlet line 12. Surge tank 1 has not as yet intercepted any liquid coolant in this case.

Less heat is entering than leaving in the phase illustrated in FIG. 5. The pressure will rise as soon as any vapor occurs in cooling system 3 while internal combustion engine 21 is in operation. Liquid coolant will be forced into surge tank 1 and the resulting vapor will flow through condensation radiator 7 until equilibrium is attained, when enough condenser surface will be exposed to dissipate the heat released to the coolant from internal combustion engine 21. The level of liquid in condensation radiator 7 and in the vicinity of second valve 17 will oscillate in accordance with the heat output from internal combustion engine 21 and with the efficiency of the condenser, which depends on the driving speed and ambient temperature. Second valve 17 is again a float and opens and closes in accordance with the level of the liquid. The suction generated by coolant pump 14 will produce a difference in pressure at third check valve 27 as soon as second valve 17 closes and will gradually open it. In this situation liquid will be suctioned out of condensation radiator 7 and/or liquid-coolant compartment 5 in surge tank 1. This procedure ensures that all liquid levels will remain constant at constant operating conditions and will rapidly adjust to varying operating conditions. Thermostatic valve 24 will regulate the flow of coolant from bypass 25 and convection radiator 8 to coolant pump 14 in accordance with the ambient temperature of the coolant. Surge tank 1 has intercepted the liquid forced out of liquid-coolant compartment 5 by the vapor in cooling system 3, displacing partition 4 toward spring compartment 6 and reducing the size of the latter. The system pressure in cooling system 3 can vary in accordance with the characteristic of compression spring 18.

FIG. 6 illustrates the extreme case that cooling system 3 has been designed to cope with. As much heat is entering as is leaving. The volume of vapor, especially in condensation radiator 7, has increased again and forced liquid out of liquid-coolant compartment 5. Spring compartment 6 is even smaller than it was in the states illustrated in FIGS. 4 and 5. The level of liquid in the vicinity of second valve 17 has dropped again and closed it, as illustrated by way of example. The suction deriving from coolant pump 14 generates a vacuum in communicating line 2, opening third check valve 27.

A valve in the form of a float can, like the one illustrated in FIGS. 1 through 3, be accommodated in condensation radiator 7. In extreme driving conditions, with the vehicle rapidly taking a curve for example, this valve will ensure that the coolant pump suctions only liquid coolant and not gaseous coolant out of surge tank 1. To prevent decreasing the percentage of antifreeze in the coolant in condensation radiator 7, the intake is designed to ensure that the vaporous coolant will entrain particles of liquid coolant and forward them to condensation radiator 7. This liquid coolant with its percentage of antifreeze will be returned to circulation in condensation radiator 7 by way of the condensate-recirculation line 10 illustrated in FIGS. 1 through 3. The systems illustrated in FIGS. 1 through 6 all have air-removal lines 26 to simplify the addition of coolant. Neck 23 has a cap with a safety valve that opens to the atmosphere in the event of a hazardous system pressure.

In summary, it is extremely easy to add coolant to cooling system 3, which is designed to be highly efficient and have excellent operating properties and has substantial advantages over known systems at low ambient temperatures. Due to its relatively simple operating principle, furthermore, the system is extremely reliable and easy to assemble.

There has thus been shown and described a novel evaporation-cooled internal combustion engine which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In an evaporation-cooled internal combustion engine having a pressurizable cooling system including a surge tank and a radiator, the improvement wherein the surge tank communicates through a line with a section of the cooling system that is constantly full of liquid coolant while the engine is in operation; wherein the cooling system includes at least one condensation radiator; and wherein a convection radiator parallels the condensation radiator.

2. The internal combustion engine as defined in claim 1, wherein the condensation radiator has coolant-distribution lines.

3. The internal combustion engine as defined in claim 1, wherein the condensation radiator includes a condensate-recirculation line.

4. In an evaporation-cooled internal combustion engine having a pressurizable cooling system including a surge tank and a radiator, the improvement wherein the surge tank communicates through a line with a section of the cooling system that is constantly full of liquid coolant while the engine is in operation; wherein the cooling system further includes a coolant-intake line and a coolant-outlet line and wherein the cooling system is completely full of liquid coolant during vapor-free operation.

5. The internal combustion engine as defined in claim 4, wherein the cooling system further includes a check valve between the coolant-intake line and the coolant-outlet line that permits flow only toward the coolant-outlet line.

6. The internal combustion engine as defined in claim 4, wherein the cooling system further includes a thermostatic valve upstream of the coolant-outlet line.

7. The internal combustion engine as defined in claim 6, wherein the cooling system includes a convection radiator and wherein the thermostatic valve is associated with the convection radiator and with a bypass adjacent thereto, controlling the flow of coolant from the convection radiator and bypass to the coolant-outlet line.

8. The internal combustion engine as defined in claim 4, wherein a coolant pump is accommodated in the coolant-outlet line and has associated with it a check valve that permits flow only toward the internal combustion engine.

9. The internal combustion engine as defined in claim 8, wherein a first valve is positioned upstream of the coolant pump.

10. The internal combustion engine as defined in claim 9, wherein the cooling system includes at least one condensation radiator and a second valve is positioned upstream of the condensation radiator.

11. The internal combustion engine as defined in claim 10, wherein both the first valve and the second valve are float valves.

12. In an evaporation-cooled internal combustion engine having a pressurizable cooling system including a surge tank and a radiator, the improvement wherein the surge tank communicates through a line with a section of the cooling system that is constantly full of liquid coolant while the engine is in operation; and wherein the surge tank comprises a partition formed of a piston arranged to move within a cylinder.

13. The internal combustion engine as defined in claim 12, wherein the piston rests against a compression spring disposed at one end of the cylinder.

14. The internal combustion engine as defined in claim 13, wherein the end of the cylinder containing the spring communicates with the internal combustion engine's intake system through a vacuum line that can be closed off by at least one shut-off valve.

15. The internal combustion engine as defined in claim 14, wherein a vacuum reservoir is associated with the vacuum line.

* * * * *